US006581683B2

(12) United States Patent
Ohanesian

(10) Patent No.: US 6,581,683 B2
(45) Date of Patent: Jun. 24, 2003

(54) WATER WELL FILTER APPARATUS

(76) Inventor: Harout Ohanesian, 9 Tattersail La., Laguna Niguel, CA (US) 92677

( * ) Notice: Subject to any disclaimer, the term of this patent is extended or adjusted under 35 U.S.C. 154(b) by 0 days.

(21) Appl. No.: 09/812,154

(22) Filed: Mar. 19, 2001

(65) Prior Publication Data

US 2001/0042620 A1 Nov. 22, 2001

Related U.S. Application Data

(63) Continuation-in-part of application No. 09/346,494, filed on Jun. 30, 1999, now Pat. No. 6,202,750.

(51) Int. Cl.[7] ..... E03B 3/18; E21B 43/02
(52) U.S. Cl. ..... 166/236; 166/228
(58) Field of Search ..... 166/227, 228, 166/234, 235, 236

(56) References Cited

U.S. PATENT DOCUMENTS

| | | | | | |
|---|---|---|---|---|---|
| 3,357,564 | A | | 12/1967 | Medford, Jr. et al. | |
| 4,014,387 | A | | 3/1977 | Fink | |
| 4,406,326 | A | * | 9/1983 | Wagner | 166/227 |
| 4,624,319 | A | | 11/1986 | Van Der Borght | |
| 4,649,996 | A | | 3/1987 | Kojicic | |
| 4,917,183 | A | | 4/1990 | Gaidry et al. | |
| 5,050,678 | A | | 9/1991 | Gaidry et al. | |
| 5,115,864 | A | | 5/1992 | Gaidry et al. | |
| 5,150,753 | A | | 9/1992 | Gaidry et al. | |
| 5,551,513 | A | | 9/1996 | Surles et al. | |
| 5,642,781 | A | | 7/1997 | Richard | |
| 5,855,242 | A | | 1/1999 | Johnson | |
| 6,006,829 | A | * | 12/1999 | Whitlock et al. | 166/228 |
| 6,180,197 | B1 | * | 1/2001 | Nie et al. | 138/137 |

* cited by examiner

*Primary Examiner*—David Bagnell
*Assistant Examiner*—Jennifer R. Dougherty
(74) *Attorney, Agent, or Firm*—Myers Dawes Andras & Sherman; Vic Y. Lin, Esq.

(57) ABSTRACT

A water well filter apparatus includes a conduit with multiple layers. The conduit comprises an inner layer, middle layer and outer layer with each layer comprising a composite of polymers, preferably ABS and unplasticized PVC. The thicker middle layer also includes a higher proportion of ABS than the other layers for rigidity and heat deflection. The inner and outer layers have a higher proportion of UPVC for greater chemical and impact resistance. The conduit further includes slots and mating end portions enabling the conduit to be coupled end-to-end with additional conduits to form an elongated filter assembly. A dual cylinder apparatus comprises an inner conduit and an outer conduit with each conduit having an inner layer, middle layer and outer layer composed of a composite of polymers. A permeable cover is disposed over the inner conduit. Filter granules are disposed in the gap between the two conduits.

24 Claims, 11 Drawing Sheets

WATER WELL FILTER APPARATUS

RELATED APPLICATIONS

This application is a continuation-in-part of U.S. patent application Ser. No. 09/346,494 filed Jun. 30, 1999, now U.S. Pat. No. 6,202,750 entitled "DUAL CYLINDER WATER WELL FILTER AND METHOD OF USING THE SAME".

BACKGROUND OF THE INVENTION

1. Field of the Invention

The invention relates to the field of water well filters.

2. Description of Prior Art

In certain geographical areas, aquifer layers containing water exist beneath the surface layers of the earth. Wells may be provided to access the aquifer layers and a filtering device may be inserted into the well to extract and filter the water in the aquifer layers. Water from the aquifer layers naturally contain a substantial amount of particulate matter. Such water when satisfactorily filtered and extracted can be used for a number of beneficial purposes.

Screened metal pipes have been used to filter water in wells. Metal pipes, however, tend to be heavy which presents a problem for workers who have to manually insert and lower the pipes into the wells. Metal pipes also deteriorate quickly in the water well environment, which can lead to weakness in the vertical pipe column. As a result of prolonged contact with water, detritus may develop and cause the metal to rust, allowing bacteria to develop and contaminate the water.

Screened plastic pipes have also been used to filter water in wells. However, both plastic and metal filters consist of pipes attached end to end to form a single conduit having only a single wall between the exterior and the interior of the conduit. Thus, the single-walled filters tend to allow particulate matter in the water which are smaller than the size of the screen to pass through into the water distribution system inside the filter.

Significant water flow into the pipe is important since the water will have to be moved up along the pipe. Typically, this is accomplished with a pump disposed inside and at the bottom of the pipe. If insufficient water flows into the pipe, the pump will be unable to move the water up along the pipe to its intended destination. To increase water flow, more screens can be formed into the pipes. However, increasing the number of screens or casings adds further weight to the total pipe column. The weight of the column may cause certain pipes, such as plastic pipes, to break as the tensile strength capability of the pipe is exceeded. Thus, adding more screens weakens the pipe and decreases its longevity. While increasing the thickness of the pipe wall might slightly increase its tensile strength capability, it reduces the cross-sectional area of the pipe's passageway, thereby reducing flow. Furthermore, increasing the wall thickness also adds weight which increases difficulties in handling such a pipe. At a given depth, the increased weight of the pipe will exceed the pipe's tensile strength, causing the pipe to break.

In addition, as the depth of a well increases, the temperature of water found inside the well also increases.

BRIEF SUMMARY OF THE INVENTION

The invention is a water well filter. An outer pipe is concentric with an inner pipe. The outer pipe has an outer plurality of water passage apertures, or slots, while the inner pipe has an inner plurality of water passage apertures, or slots. Both the inner and outer plurality of water passage apertures extend from an outer surface to an inner surface of their respective pipe. The outer pipe has a length that is shorter than that of the inner pipe, but long enough to cover the entire inner plurality of water passage apertures. The inner pipe has an internally threaded portion at either the upper or lower end, and an externally threaded portion at an opposite end. Therefore, the upper end of the inner pipe may be attached to the lower end of another inner pipe of another water well filter, or at least the lower end of another pipe. The outer pipe is attached to non-apertured portions of the inner pipe by upper and lower sealing rings disposed at upper and lower ends of the outer pipe, respectively. The outer pipe is attached to the inner pipe so as to form an annular gap between the outer surface of the inner pipe and the inner surface of the outer pipe.

A permeable, granulated filter material fills the gap. Thus, the sealing rings serve to close the gap and seal the granulated filter material. The granulated filter material may include a bonding mechanism so that the filter granules are bonded together. The filter granules may also be bonded to the outer surface of the inner pipe and the inner surface of the outer pipe. A permeable cover comprising nylon mesh is disposed on the outer surface of the inner pipe. The permeable cover has openings with an opening cross-dimension less than the granule cross-dimension of the filter granules so that the filter granules cannot reach the inner plurality of water passage apertures.

The outer pipe, inner pipe, sealing rings and granulated filter material all comprise unplasticized polyvinyl chloride ("UPVC"). Therefore, the sealing rings may be welded onto the outer and inner pipes.

The invention also comprises a method for filtering out particulate matter from water in a well, the method comprising: passing the water through a first plurality of apertures in a first barrier; blocking an initial portion of the particulate matter with the first barrier; passing the water through filter granules; blocking a first intermediate portion of the particulate matter with filter granules; passing the water through a second plurality of apertures in a second barrier; and blocking a final portion of the particulate matter with the second barrier. The method may further comprise: disposing a permeable cover with a plurality of openings onto the second barrier; passing the water through the plurality of openings in the cover; and blocking a second intermediate portion of the particulate matter with the cover.

A conduit is provided for filtering water in a well. The conduit comprises an inner layer comprising a first plurality of polymers, a middle layer comprising a second plurality of polymers, an outer layer comprising a third plurality of polymers, slots defined in the inner layer, middle layer, and outer layer, a first end portion, and a second end portion opposite to the first end portion and adapted to mate with the first end portion.

The inner layer, middle layer and outer layer each comprise acrylic butadiene styrene and unplasticized polyvinyl chloride. The middle layer comprises a greater proportion of acrylic butadiene styrene than the inner layer and the outer layer. In a preferred embodiment, the inner layer and outer layer each comprise 10% to 20% acrylic butadiene styrene and 80% to 90% unplasticized polyvinyl chloride whereas the middle layer comprises 20% to 50% acrylic butadiene styrene and 50% to 80% unplasticized polyvinyl chloride. The middle layer has a thickness greater than a thickness of the inner layer and a thickness of the outer layer.

The first end portion comprises an externally threaded portion. The second end portion comprises an internally threaded portion. The externally threaded portion and the internally threaded portion are molded. The conduit further comprises a shoulder adjacent to the externally threaded portion. The slots are arranged into groupings, each grouping comprising an array of slots spaced closely together, each grouping spaced apart from the other.

In another aspect, a dual conduit filter apparatus is provided for use in a water well. The apparatus comprises an inner conduit, an outer conduit and filter granules disposed in a gap between the conduits. The inner conduit has a first inner layer, a first middle layer, and a first outer layer, a plurality of inner conduit slots, a first end portion, and a second end portion opposite to the first end portion and adapted to mate with the first end portion. The first inner layer, first middle layer and first outer layer each comprise a plurality of polymers. The first inner layer, first middle layer and the first outer layer each comprise acrylic butadiene styrene and unplasticized polyvinyl chloride. The first end portion comprises an externally threaded portion. The second end portion comprises an internally threaded portion. The externally threaded portion and the internally threaded portion are molded.

The outer conduit is coupled to the inner conduit and spaced apart from the inner conduit to form a gap. The outer conduit has a plurality of outer conduit slots, an outer pipe length less than the inner pipe length, the outer pipe length being such that the outer pipe covers the plurality of inner pipe slots. The outer conduit comprises a second inner layer, a second middle layer and a second outer layer. The second inner layer, the second middle layer and the second outer layer each comprise acrylic butadiene styrene and unplasticized polyvinyl chloride.

The filter apparatus further comprises seals coupling the outer conduit to the inner conduit and a permeable cover disposed on an outer surface of the inner conduit. The permeable cover has openings with an opening cross-dimension.

In another aspect, a filter assembly comprises multiple conduits coupled in an abutting, end-to-end arrangement to form an elongated structure for use in a water well. The assembly comprises a first conduit, a second conduit, and means for removably coupling one of the first pair of end portions of the first conduit to one of the second pair of end portions of the second conduit. A first conduit has a first inner layer, a first middle layer, a first outer layer, a first plurality of slots, and a first pair of end portions. A second conduit is removably coupled to the first conduit in an abutting end-to-end arrangement. The second conduit has a second inner layer, a second middle layer, a second outer layer, a second end portion, a second plurality of slots, and a second pair of end portions;

The first inner layer, first middle layer and first outer layer each comprise a first composite material composed of a first plurality of polymers. The first composite material comprises acrylic butadiene styrene and unplasticized polyvinyl chloride. The second inner layer, second middle layer and second outer layer each comprise a second composite material composed of a second plurality of polymers. The second composite material comprises acrylic butadiene styrene and unplasticized polyvinyl chloride.

The means for removably coupling one of the first pair of end portions of the first conduit to one of the second pair of end portions of the second conduit comprises a first internally threaded portion and a first externally threaded portion formed at opposite ends of the first conduit, and a second internally threaded portion and a second externally threaded portion formed at opposite ends of the second conduit. Alternatively stated, the first pair of end portions comprise the first internally threaded portion and the first externally threaded portion. Similarly, the second pair of end portions comprise the second internally threaded portion and the second externally threaded portion.

The first conduit comprises a shoulder adjacent to the first externally threaded portion. The assembly further comprising a sealing ring disposed adjacent to the shoulder.

In summary, the water well filter apparatus includes a conduit with multiple layers. The conduit comprises an inner layer, middle layer and outer layer with each layer comprising a composite of polymers, preferably ABS and unplasticized PVC. The thicker middle layer also includes a higher proportion of ABS than the other layers for extra strength and heat deflection. The inner and outer layers have a higher proportion of UPVC for greater chemical and impact resistance. The conduit further includes slots and mating end portions enabling the conduit to be coupled end-to-end with additional conduits to form an elongated filter assembly. A dual cylinder apparatus comprises an inner conduit and an outer conduit with each conduit having an inner layer, middle layer and outer layer composed of a composite of polymers. A permeable cover is disposed over the inner conduit. Filter granules are disposed in the gap between the two conduits.

The invention, now having been briefly summarized, may be better visualized by turning to the following drawings wherein like elements are referenced by like numerals.

The invention and its various embodiments can now be better understood by turning to the following detailed description wherein an illustrated embodiment is described. It is to be expressly understood that the illustrated embodiment is set forth as an example and not by way of a limitation to the invention as defined in the following claims.

DETAILED DESCRIPTION OF THE PREFERRED EMBODIMENTS

Figure 1:
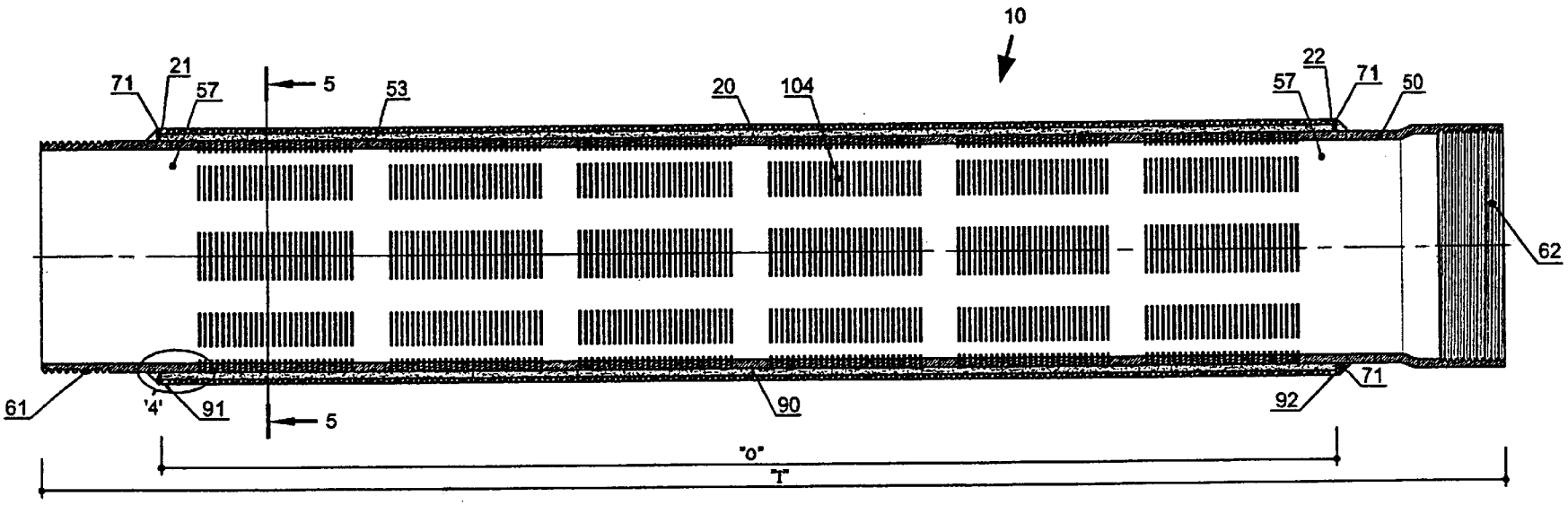
FIG. 1 is a longitudinal sectional view of a filter apparatus according to the invention.

FIG. 1 is a longitudinal cross-section view of the invention 10 comprising a water well filter. The invention 10 comprises an outer cylinder 20 surrounding an inner cylinder 50. The cylinders are preferably in the form of circular pipes made of a polymer material. In the preferred embodiment, the polymer material comprises unplasticized polyvinyl chloride ("UPVC").

Figure 2:
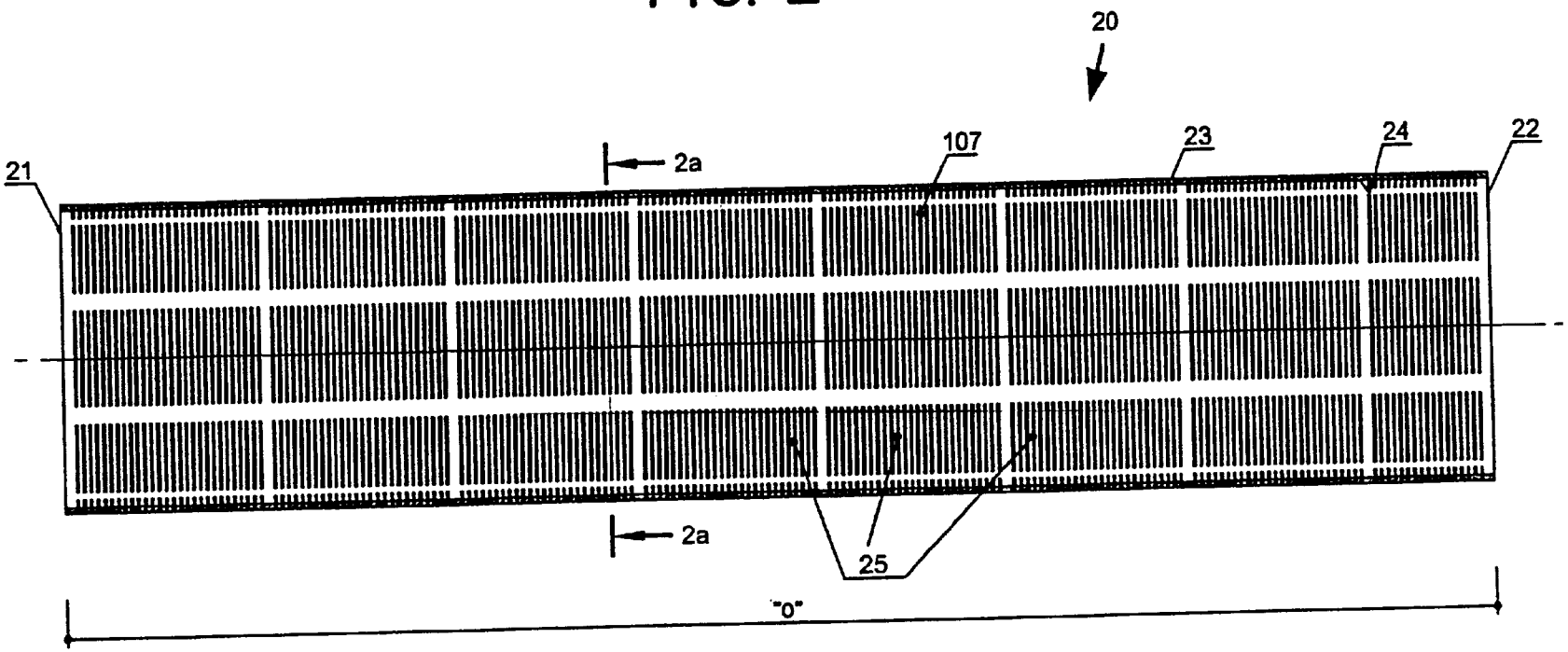
FIG. 2 is a longitudinal cross-section view of the outer cylinder.
Figure 2A:
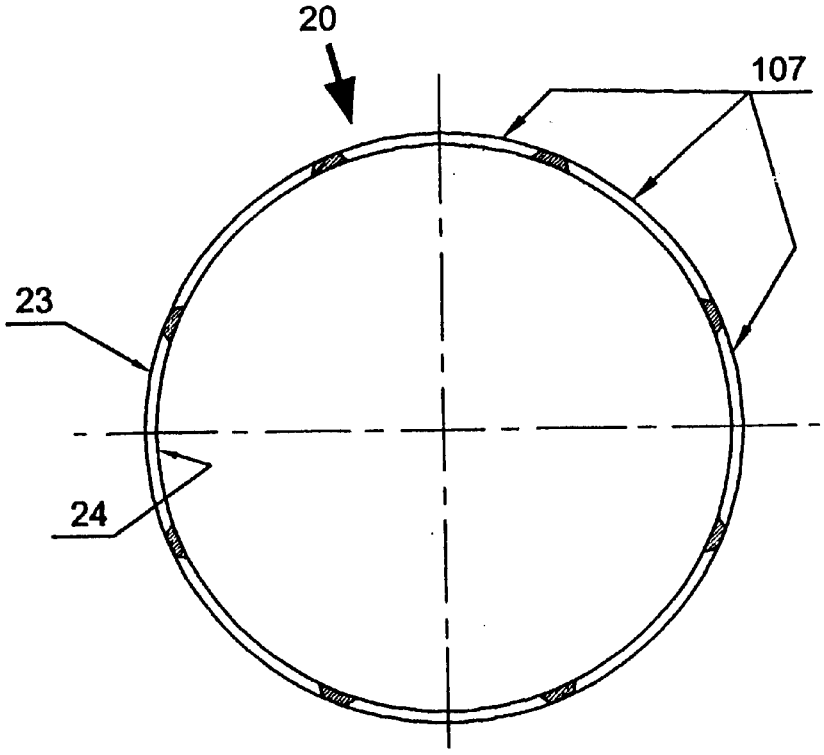
FIG. 2*a* is a perpendicular cross-section view of the outer cylinder taken along lines 2*a*—2*a* of FIG. 2.

FIG. 2 is longitudinal cross-section view of outer cylinder 20. Though it is not necessary, the preferred embodiment of the outer cylinder 20 is a pipe which is circular in profile. FIG. 2*a* is a perpendicular cross-section view of the outer cylinder 20 taken along lines 2*a*—2*a* of FIG. 2. In FIGS. 2 and 2*a*, the outer cylinder, of pipe, 20 has an outer plurality of water passage apertures 107, preferably in the form of slots, that extend from the outer surface 23 to the inner surface 24 of the outer pipe 20. In FIG. 2, the slots 107 are grouped into outer groupings 25. Thus, a pattern of outer groupings 25 are formed on the outer pipe 20 to allow maximum water throughput while retaining intergral strength for handling. The outer pipe also has an outer pipe length "O", a first or upper end 21, and a second or lower end 22.

Figure 3A:
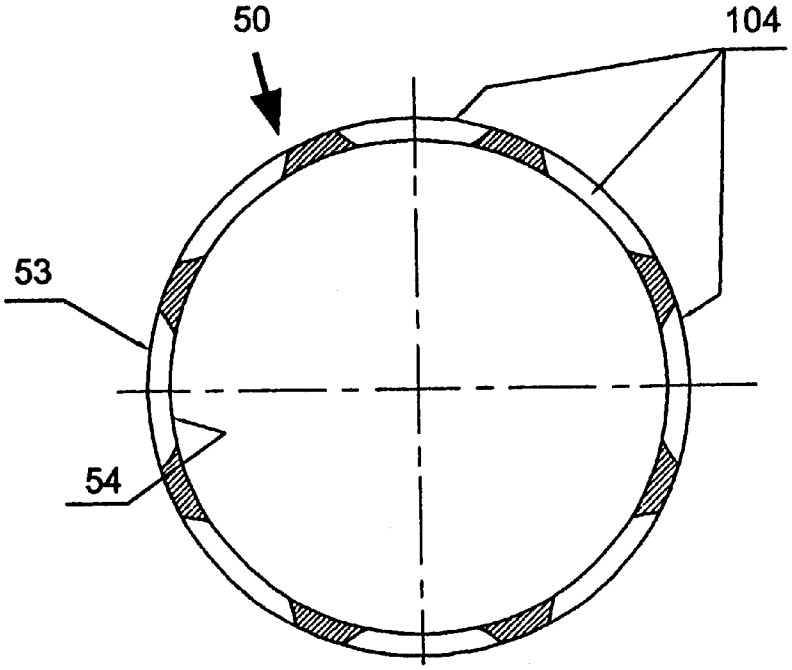
FIG. 3*a* is a perpendicular cross-section view of the inner cylinder taken along lines 3*a*—3*a* of FIG. 3.
Figure 3:
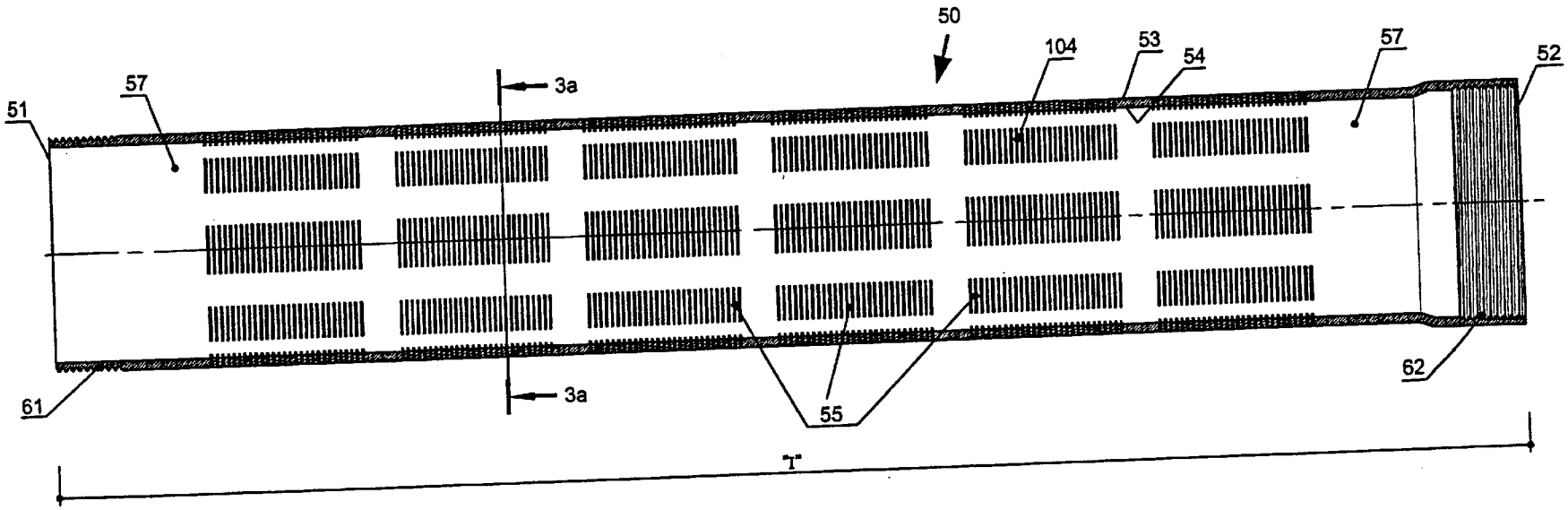
FIG. 3 is a longitudinal cross-section view of the inner cylinder or pipe 50.

FIG. 3 is longitudinal cross-section view of the inner cylinder 50. Similar to the outer cylinder 20, the inner cylinder 50 need not be, but preferably is, a pipe which is circular in profile. FIG. 3*a* is a perpendicular cross-section view of the inner cylinder 50 taken along lines 3*a*—3*a* of FIG. 3. In FIGS. 3 and 3*a*, the inner pipe 50 has an inner plurality of water passage apertures 104, also preferably in the form of slots, that extend from the outer surface 53 to the inner surface 54 of the inner pipe 50. In FIG. 3, the inner pipe slots 104 are grouped into inner groupings 55. Similar to the pattern of outer groupings 25, a pattern of inner groupings 55 are formed on the inner pipe 50 to allow maximum water throughput while retaining integral strength for handling. At a first or upper end 51 of the inner pipe 50, an externally threaded portion 61 is formed. At an opposite second or lower end 52, an internally threaded portion 62 is formed. However, the externally threaded portion 61 may be located at the second end 52, and the internally threaded portion 62 may be located at the first end 51 so long as the upper end 51 of the inner pipe 50 comprises means to attach to a lower end of another water well filter (not shown). The inner pipe 50 has an inner pipe length "I". Adjacent to the first and second ends 51, 52 are non-apertured portions 57.

In FIG. 1, the inner pipe length "I" is greater than the outer pipe length "O". The inner pipe slots 104 are formed and the outer pipe 20 is coupled to the inner pipe 50 such that the inner pipe slots 104 are all covered by the outer pipe 20. Thus, the length "O" of the outer pipe 20 is such that when the outer pipe 20 is coupled to the inner pipe 50, the outer pipe 20 covers all the inner pipe slots 104 and overlaps onto the solid, non-apertured portions 57 of the inner pipe 50. The outer pipe 20 is coupled to the inner pipe 50 by annular sealing rings 71 disposed at the upper and lower ends 21, 22 of the outer pipe 20. The sealing rings 71 are preferably made of the same UPVC material as that of the inner and outer pipes 20, 50. Therefore, the sealing rings 71 may be welded onto the inner and outer pipes 20, 50 to firmly fix the outer pipe 20 to the outer surface 53 of the inner pipe 50.

Figure 4:
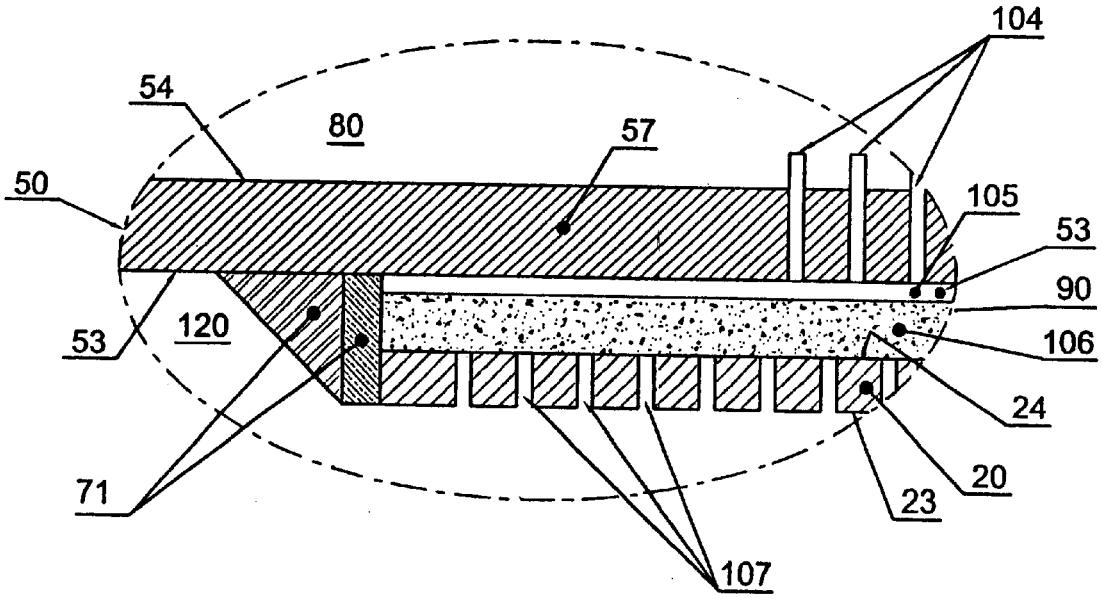
FIG. 4 is a close-up cross-sectional view of the encircled area 4' in FIG. 1.

FIG. 4 is a close-up cross-sectional view of the encircled area 4' in FIG. 1. The outer pipe 20 is coupled to the inner pipe 50 by the sealing rings 71 such that a gap 90 is defined between the outer surface 53 of the inner pipe 50 and the inner surface 24 of the outer pipe 20. In FIG. 1, the gap 90 has a first end 91 adjacent to the first end 21 of the outer pipe 20 and a second end 92 adjacent to the second end 22 of the outer pipe 20. In FIG. 4, a permeable, granulated filter material 106 fills the gap 90. Thus, the sealing rings 71 serve to close the gap 90 and seal in the granulated filter material 106 disposed in the gap 90. In the preferred embodiment, the granulated filter material 106 comprises granules of UPVC. The granulated filter material 106 may also comprise granules of sand, gravel, or other fine granulated material which when compacted together prevent the entry of foreign particles while allowing liquid to flow through.

In FIG. 4, a permeable cover 105 having openings (not shown) is disposed on the outer surface 53 of the inner pipe 50. The permeable cover 105 prevents filter granules 106 from entering the inner plurality of water passage apertures 104 which typically have an inner aperture cross-dimension greater than the cross-dimension of the filter granules 106. The permeable cover 105 preferably consists of nylon mesh. The openings (not shown) on the permeable cover 105 have a cross-dimension less than the cross-dimension of the granules 106 such that the granules 106 cannot pass through the nylon mesh cover 105 and enter through the inner pipe slots 104. The granulated filter material 106 may be densely packed.

The granulated filter material 106 may include a bonding mechanism (not shown) which bonds the filter granules 106 to each other. The bonding mechanism may also be used to bond the granules to: 1) first, the inner surface 24 of the outer pipe 20, and 2) second, the outer surface 53 of the inner pipe 50, or the permeable cover 105. The permeable cover 105 might not be necessary when the filter granules 106 are bonded because the bonded granules 106 will not escape through the inner plurality of water passage apertures 104.

In FIG. 1, the externally threaded portion 61 and the internally threaded portion 62 allow the water well filter 10 to be threadedly connected to additional water well filters, thus forming an elongated structure consisting of multiple water well filters. The elongation enables filtering of water at deep underground levels such as in the aquifer levels.

Figure 5:
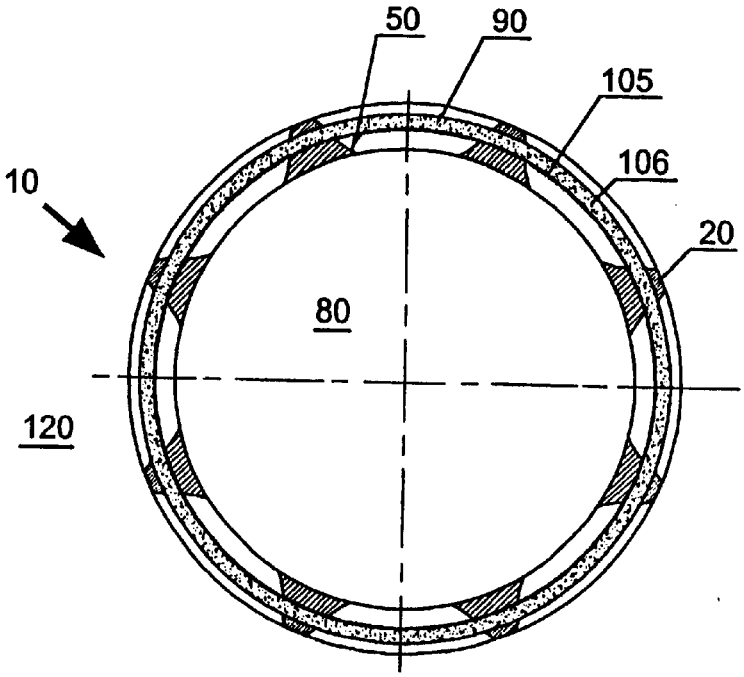
FIG. 5 is a perpendicular cross-section view of the water well filter 10 taken along lines 5—5 of FIG. 1.

FIG. 5 is a perpendicular cross-section view of the water well filter 10. From an exterior 120 to an interior 80 of the water well filter 10, FIG. 5 shows the outer pipe 20, the granulated filter material 106, the mesh covering 105, and the inner pipe 50. Where the inner and outer pipes 50, 20 are circular in profile and concentric, as shown in FIG. 5, the gap 90 and the sealing rings 71 (shown in FIG. 1) are, therefore, annular.

The structure of the water well filter 10 now having been described, turn now to its operation.

Figure 6:
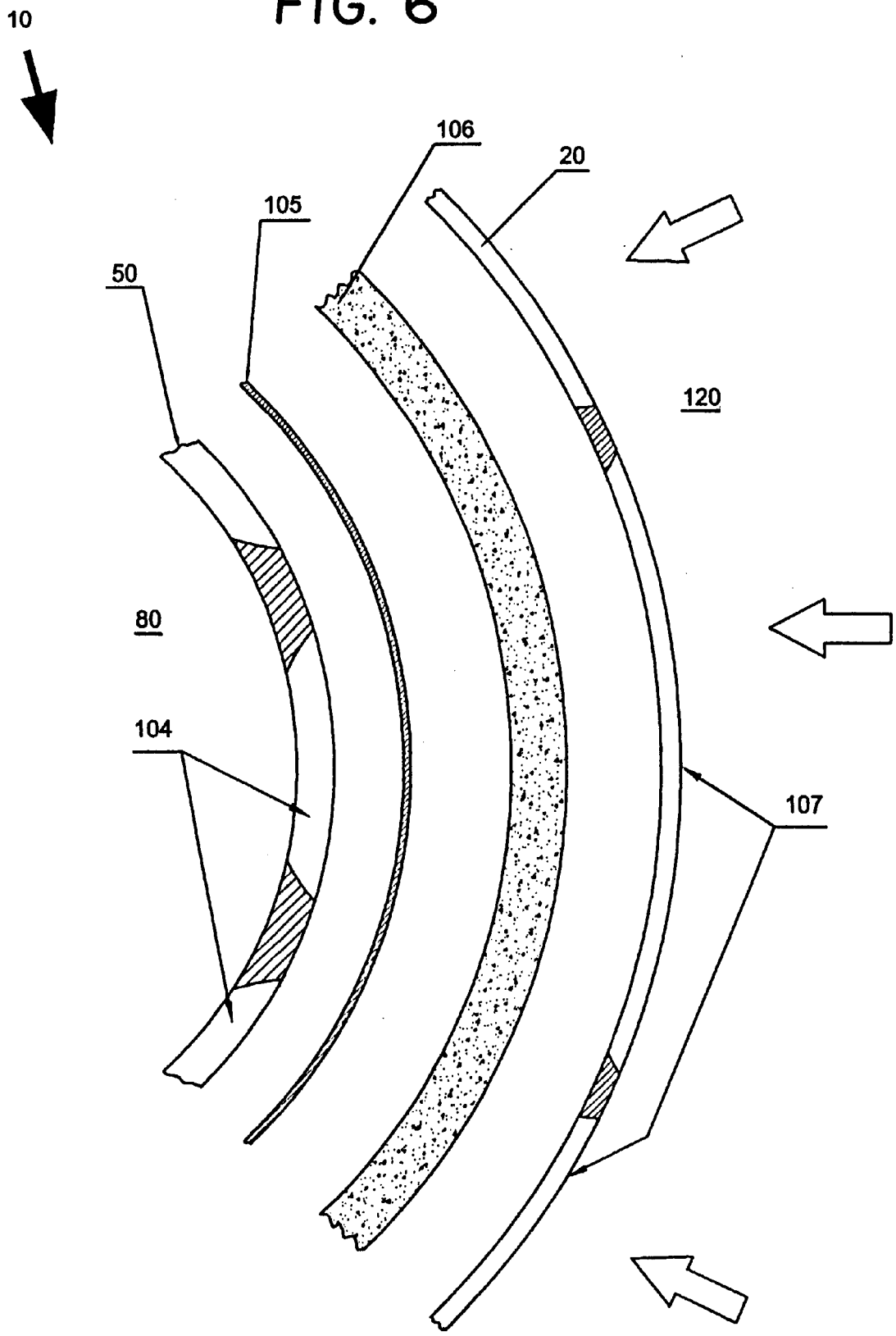
FIG. 6 is an exploded view of the perpendicular cross-section shown in FIG. 5.

FIG. 6 is an exploded view of the perpendicular cross-section shown in FIG. 5. Thus, in FIG. 6, water (depicted by arrows) containing particulate matter (not shown) will first encounter the outer pipe slots 107. The outer pipe slots 107 will prevent larger particles from entering through the outer pipe 20. As water containing smaller particles enters through the outer pipe 20, the granulated filter material 106 halts the progress of such smaller particles while allowing water to pass through. The nylon mesh covering 105 serves as an additional filter to block any particles which may have passed through the granulated filter material 106. The inner pipe slots 104 serve as a final filter to block any minute particles that may have passed through the nylon mesh covering 105. Unlike prior art filters which include only one pipe wall, and thus only one level of filtering, between the exterior and the interior of the filter, the water well filter 10 comprises four levels of filtering between the exterior 120 and the interior 80 of the water well filter 10:

1) outer pipe slots 107;
2) granulated filter material 106;
3) nylon mesh covering 105; and
4) inner pipe slots 104.

Therefore, it can be appreciated that the water well filter 10 provides more extensive and effective filtering, which leads to cleaner water than prior art filters. Since the outer pipe 20, inner pipe 50, sealing rings 71 and granulated filter material all comprise of UPVC, the various components will not mix or react chemically with each other. Also, since UPVC can be recycled, the use of UPVC leads to greater efficiency and less expense in the manufacturing of the water well filters 10. Furthermore, UPVC will not react or undergo detritus as a result of prolonged contact with water. Being low in density, UPVC is lighter in weight, and yet more durable, than metal, thus making the water well filter 10 easier to use and longer lasting.

Unlike prior art plastic filters which include only a single pipe, the dual pipe structure of the water well filter 10 makes the entire filter 10 stronger. The outer pipe 20 reinforces the strength of the inner pipe 50 while the inner pipe 50 reinforces the strength of the outer pipe 20. Therefore, as each pipe 20, 50 reinforces the other, the overall column strength of the water well filter 10 is increased, thereby allowing each pipe to contain more slots. Having more slots leads to higher water throughput. Therefore, the present invention 10 allows for greater water throughput than the prior art because the single pipe filter in the prior art could not contain more slots beyond a certain amount without weakening the column strength of the filter.

In addition to the dual pipe structure, an alternate filter apparatus 200 comprising a single conduit 220 is also provided which overcomes the deficiencies of single pipe filters in the prior art. As described in further detail below, the single conduit 220 comprises a multi-layer wall that allows a plurality of slots to be defined therein without weakening the overall strength of the conduit 220. In a preferred embodiment, the conduit 220 is preferably shaped as a circular pipe and composed of one or more polymer materials. An internally threaded portion 231 is disposed at a first end 225 and adapted to mate with an externally threaded portion 232 disposed at a second, opposite end 226. The mating portions 231, 232 allow the water conduit 220 to be threadedly coupled to additional conduits to form an elongated filter structure comprising multiple conduits. In a preferred embodiment, the threaded portions 231, 232 are formed by molding as opposed to being cut out. This molding process maintains the thickness of the threaded portions 231, 232, keeping it substantially similar to the wall thickness of the remainder of the conduit 220. Thus, the molded end portions 231, 232 maintain the column strength of a pipe assembly comprising multiple conduits 220. The elongation enables filtering of water at deep underground levels such as in the aquifer levels.

Figure 9:
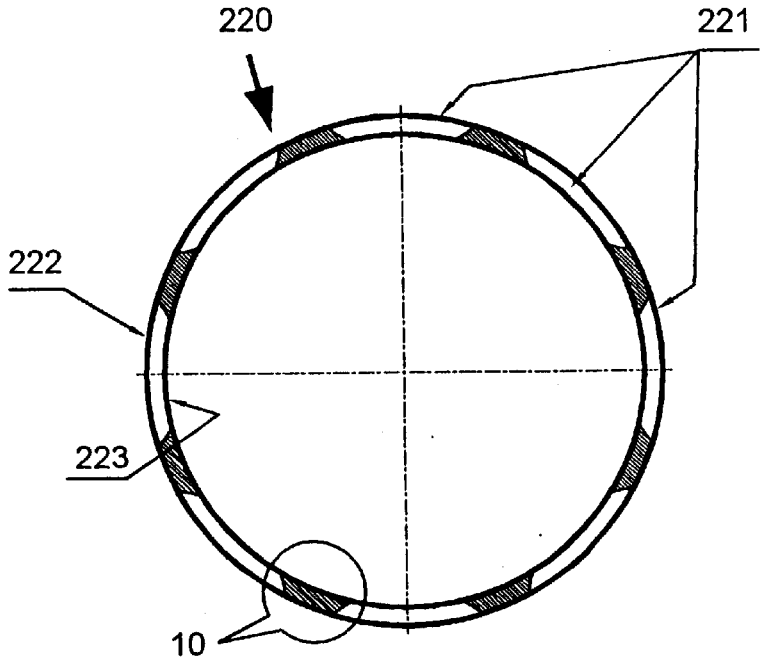
FIG. 9 is a perpendicular cross sectional view of the alternate filter apparatus taken along line 9'—9' of FIG. 7.
Figure 10:
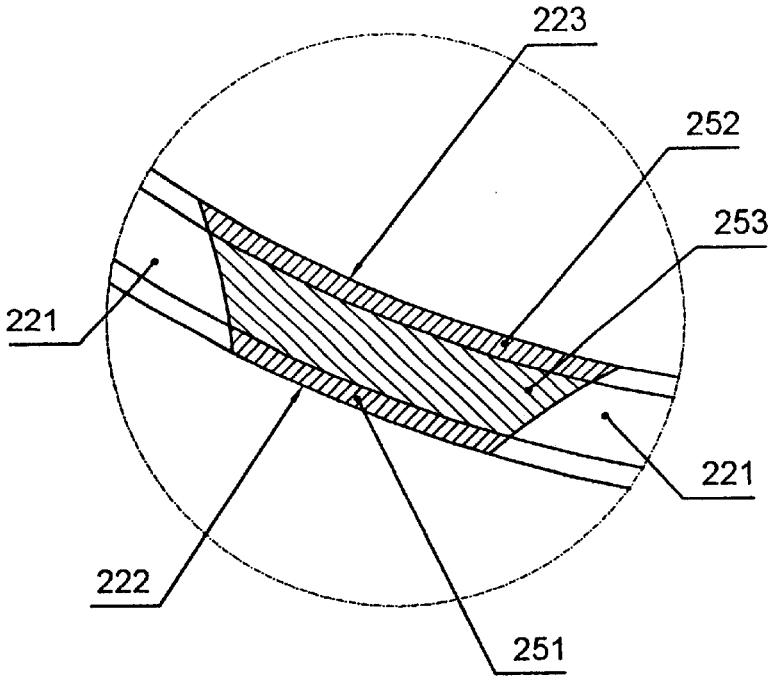
FIG. 10 is a close-up cross-sectional view of the encircled area 10' of FIG. 9.
Figure 11:
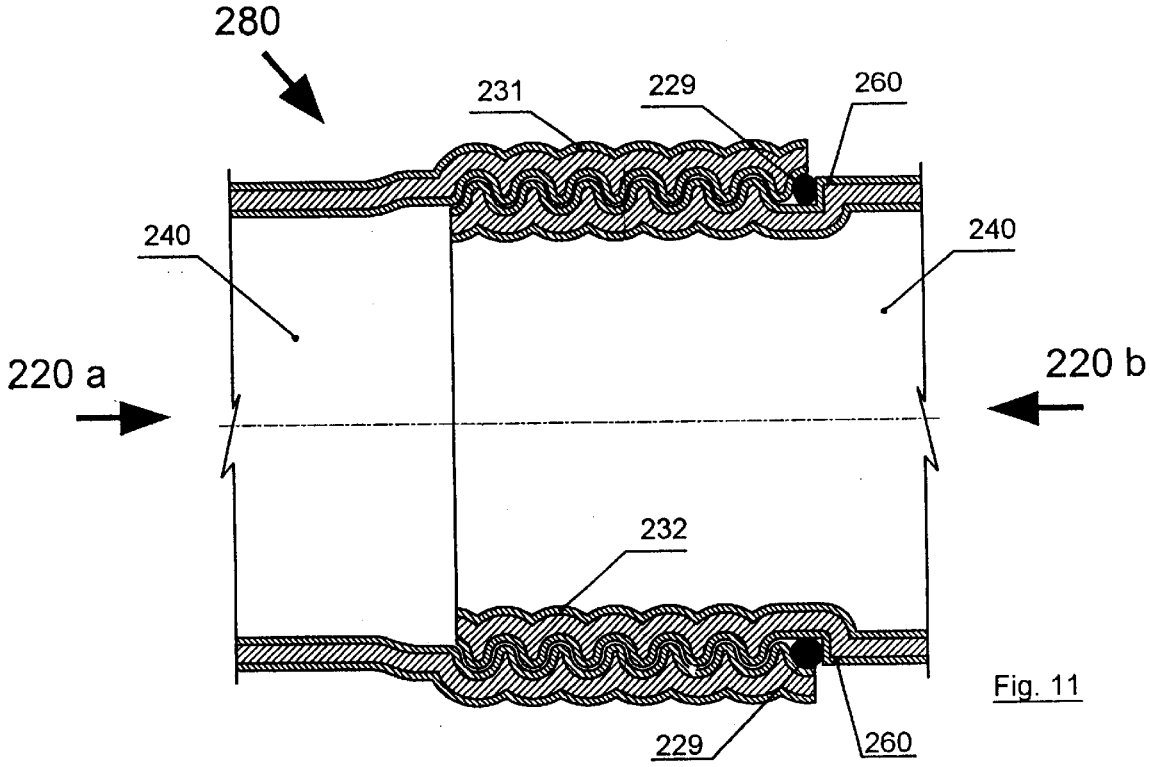
FIG. 11 is a longitudinal cross-sectional view of the threaded joint coupling of two conduits.

Similar to the inner cylinder 50 in FIG. 3, the conduit 220 comprises a plurality of water passage apertures 221 arranged into groupings 224. The pattern of groupings 224 is configured to allow maximum water throughput while retaining integral strength for handling. The water passage apertures 221 preferably comprise slots that extend from the outer surface 222 to the inner surface 223 of the conduit 220 as shown in FIGS. 9 and 10. The conduit 220 further comprises non-apertured portions 240 adjacent to the threaded portions 231, 232. The pipe also has a length "L1". A shoulder 260 is provided between the externally threaded portion 232 and the adjacent non-apertured portion 240. The shoulder 260 is adapted for holding a sealing ring 229 as shown in FIG. 11.

Figure 8:
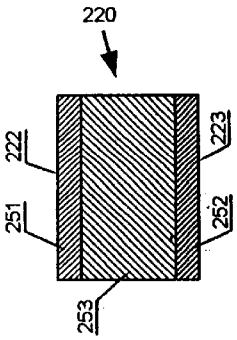
FIG. 8 is a close-up cross-sectional view of the encircled area 8' of FIG. 7.
Figure 7:
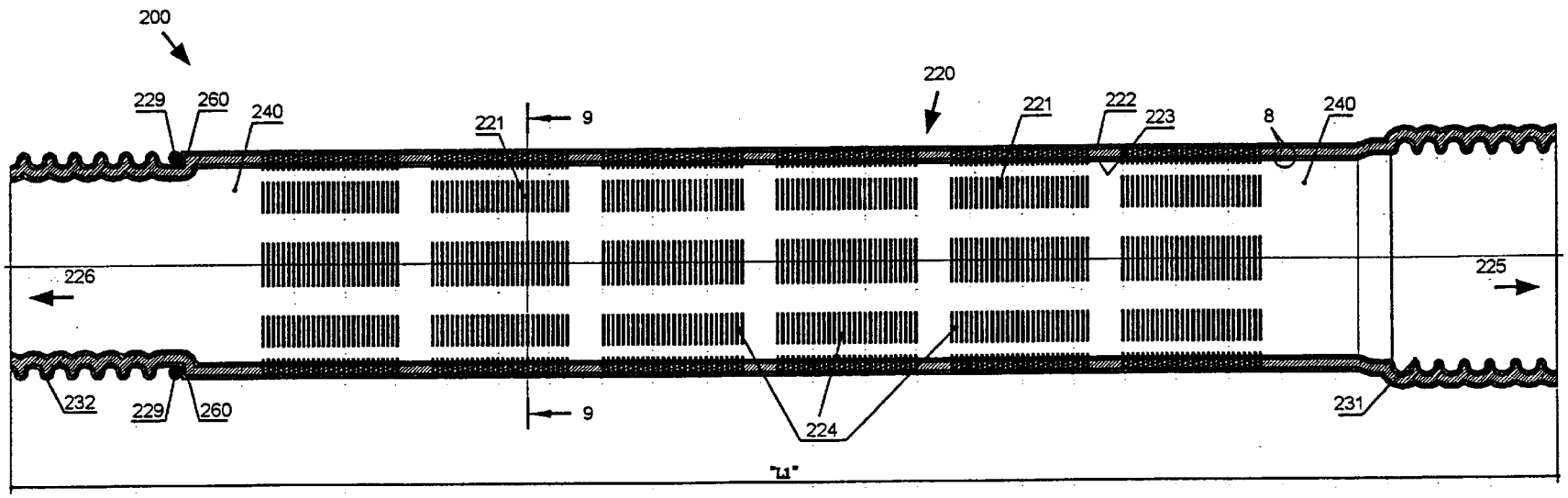
FIG. 7 is a longitudinal cross-sectional view of an alternate filter apparatus according to the invention.

FIG. 8 is a close-up cross-sectional view of the encircled area 8' of FIG. 7 illustrating the multi-layer configuration of the conduit 220. The wall of the conduit 220 is initially formed through a process of multi-layer extrusion, also known as co-extrusion. As shown in FIG. 8, the layers 251, 252, 253 are formed through the co-extrusion process such that they are integral with each other to form a single wall. An inner layer 252 includes a composite material comprising a mixture of two or more polymers. In the preferred embodiment, the inner layer 252 comprises a mixture of acrylic butadiene styrene (ABS) and UPVC. The mixture preferably comprises an approximate ratio of 10–20% ABS to 80–90% UPVC, depending upon the demands of the water well environment. This compound mixture provides the attributes of higher chemical and scratch resistance for the inner layer 252 and the inner surface 223.

The middle, or center, layer 253 is a relatively thicker layer including a composite material also comprising primarily of a mixture of two or more polymers. In a preferred embodiment, the polymers comprise ABS and UPVC material in an approximate ratio of 20–50% ABS to 50–80% UPVC depending upon the demands of the water well environment. This compound mixture provides the attributes of higher heat deflection and increased strength for the middle layer 253.

The outer layer 251 is a relatively thin layer of a composite material also comprising primarily of a mixture of two or more polymers. In a preferred embodiment, the composite material of the outer layer 251 is substantially similar to that of the inner layer 252, namely, a combination of ABS and UPVC in an approximate ratio of 10–20% ABS and 80–90% UPVC, also depending upon the water well environment. This compound mixture provides the attributes of higher chemical and scratch resistance for the outer layer 251 and the outer surface 222.

Therefore, it will be appreciated that in the preferred embodiment, the central layer 253 has a higher strength than the inner layer 252 and the outer layer 251 due to both its increased thickness and differing compound mixture. The unique multi-layered aspect of the conduit 220 and its unique composition of polymers increase the column strength of the overall conduit 220 and enable a multitude of water passage apertures 221, also preferably in the form of slots, to be configured therein without compromising the column strength. Thus, maximum throughput and column strength are achieved.

Since the inner layer 252 and the outer layer 251 are more openly exposed to the liquid being filtered than the central layer 253, it will also be appreciated that the inner and outer layers 252, 251 contain a higher percentage of UPVC than the middle layer 253 in order to provide greater resistance to chemical attacks and scratches. With its heat deflection properties, the amount of ABS contained in the various layers 251, 252, 253, and especially the increased ABS percentage in the middle layer 253, provide an overall conduit 220 with a much higher temperature deflection than those of the prior art. This enables the conduit 220 to operate at lower depths wherein hotter liquid is found.

With the mating end portions 231, 232, the conduit 220 may be coupled to additional conduits in an abutting, end-to-end arrangement to form an elongated filter assembly. FIG. 11 is a longitudinal cross-sectional view of a filter assembly 280, and, in particular, the coupling of the threaded end portions 231, 232 of two pipes 220*a*, 220*b*. The squared indentation 260 between the externally threaded portion 232 and the non-apertured section 240 of the pipe 220*b* holds a sealing ring 229. The sealing ring 229 may be composed of natural rubber, EPDM or other materials suitable for sealing the joint in a compressional manner.

It can be appreciated that the water well conduit 220 provides effective filtering while maintaining its strength. Furthermore, UPVC and ABS will not react or undergo detritus buildup that commonly occurs in prior art filters as a result of prolonged contact with water. Being low in density, UPVC and ABS are lighter in weight, and yet more durable, than metal, thus making the water well conduit 220 easier to handle and longer lasting.

Unlike prior art plastic filters, which typically include only a single layer composed of a single material, the multi-layer structure of the water well conduit 220 makes the entire conduit 220 stronger. Therefore, as each layer 251, 252 and 253 reinforces the other in terms of reactivity to external chemical attacks, heat deflection, impact resistance, scratch resistance and tensile strength, the overall column strength of the filter apparatus 200 is increased while weight is reduced. This allows a filter assembly to be increased in length by coupling more conduits, and operated at deeper levels in higher water temperatures. Therefore, the filter apparatus 200 facilitates the construction of deeper wells which, up to now, have been impractical since single pipe filters in the prior art could not meet the strength or temperatures requirements at lower depths.

Figure 12:
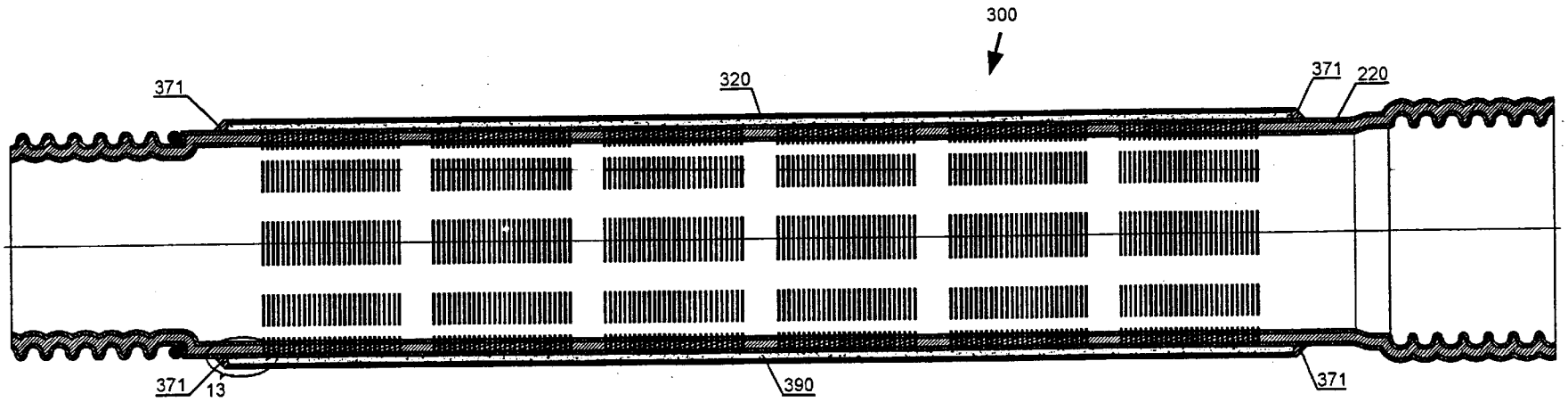
FIG. 12 is a longitudinal cross-sectional view of a further embodiment of a dual conduit filter apparatus.
Figure 13:
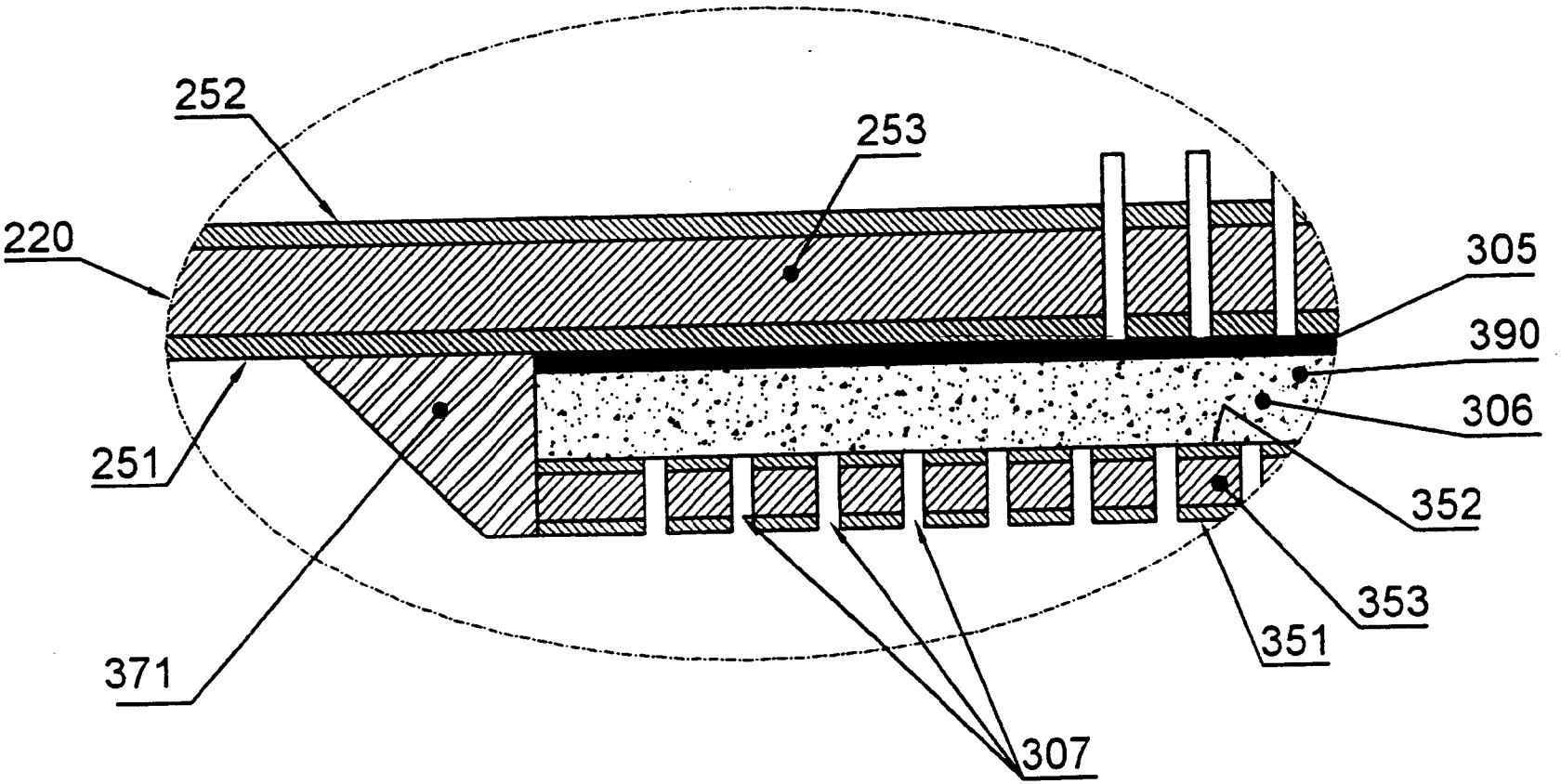
FIG. 13 is a close-up cross-sectional view of the encircled area 13' of FIG. 12.

It will further be appreciated that the multi-layer conduit 220 according to the invention may be implemented in a dual conduit filter apparatus similar to that of FIG. 1. The inner cylinder 50 of FIG. 1 may be substituted with the multi-layered conduit 220 of FIGS. 7–11 to form a dual cylinder filter assembly 300 as shown in FIGS. 12 and 13. Similarly, the outer cylinder 20 of FIG. 1 may be replaced with an outer cylinder 320 having a substantially similar configuration of apertures, or slots, 307, with the primary difference being that the outer cylinder 320 as shown in FIG. 13 comprises a multi-layer configuration. Similar to the multi-layered configuration of the inner conduit 220 that includes an outer layer 251, a middle layer 253, and an inner layer 252, the outer conduit 320 comprises an inner layer 352, an outer layer 351, and a middle layer 353. In the preferred embodiment, each of the layers 351, 352, 353 is composed of a composite material comprising ABS and UPVC in the following proportions:

1) in the inner layer 352 and outer layer 351: 10–20% ABS and 80–90% UPVC; and
2) in the middle layer 353: 20–50% ABS to 50–80% UPVC.

Thus, similar to the inner conduit 220, the outer conduit 320 comprises a middle layer 353 that has a greater thickness and a higher ABS content than its outer layer 351 and inner layer 352. The outer conduit 320 may be coupled to the inner conduit 220 with a sealing ring 371 composed of ABS and UPVC. A permeable covering 305, preferably comprising a mesh covering, may be disposed over the outer surface of the inner conduit 220.

Filter granules 306 are disposed in the annular gap 390 between the inner conduit 220 and the outer conduit 320. In a preferred embodiment, the filter granules 306 may also be composed of the composite comprising ABS and UPVC, or composed of other granular material of a suitable size and type. In the preferred embodiment, it will be appreciated that with the inner conduit 220, outer conduit 320, sealing rings 371 and filter granules 306 all composed of a composite comprising ABS and UPVC, the overall characteristics of heat deflection, chemical resistance and impact resistance of the apparatus 300 is maximized.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. The claims are thus to be understood to include what is specifically illustrated and described above, what is conceptionally equivalent, what can be obviously substituted and also what essentially incorporates the essential idea of the invention.

What is claimed is:

1. A conduit adapted for filtering water in a well, the conduit comprising:

a single wall comprising a plurality of co-extruded layers, the plurality of co-extruded layers including an inner layer comprising a first plurality of polymers, a middle layer comprising a second plurality of polymers, and an outer layer comprising a third plurality of polymers;

slots defined in the inner layer, middle layer, and outer layer;

a first end portion; and a second end portion opposite to the first end portion and adapted to mate with the first end portion.

2. The conduit of claim 1 wherein the inner layer, middle layer and outer layer each comprise acrylic butadiene styrene and unplasticized polyvinyl chloride.

3. The conduit of claim 1 wherein:

the first end portion comprises an externally threaded portion; and the second end portion comprises an internally threaded portion.

4. The conduit of claim 3 wherein the externally threaded portion and the internally threaded portion are molded.

5. The conduit of claim 3 further comprising a shoulder adjacent to the externally threaded portion.

6. The conduit of claim 1 wherein the slots are arranged into groupings, each grouping comprising an array of slots spaced closely together, each grouping spaced apart from the other.

7. A conduit adapted for filtering water in a well, the conduit comprising:

an inner layer comprising a first plurality of polymers;

a middle layer comprising a second plurality of polymers;

an outer layer comprising a third plurality of polymers;

slots defined in the inner layer, middle layer, and outer layer;

a first end portion; and a second end portion opposite to the first end portion and adapted to mate with the first end portion, wherein the inner layer, middle layer and outer layer each comprise acrylic butadiene styrene and unplasticized polyvinyl chloride, and wherein the middle layer comprises a greater proportion of acrylic butadiene styrene than the inner layer and the outer layer.

8. The conduit of claim 7 wherein:

the inner layer comprises 10% to 20% acrylic butadiene styrene and 80% to 90% unplasticized polyvinyl chloride;

;oplllljuyhtgreddwspolkijhgtfrdeswaZSXCGFVBHNA \;.l,kmmjnbhgvfdcxszathe middle layer comprises 20% to 50% acrylic butadiene styrene and 50% to 80% unplasticized polyvinyl chloride; and the outer layer comprises 10% to 20% acrylic butadiene styrene and 80% to 90% unplasticized polyvinyl chloride.

9. A conduit adapted for filtering water in a well, the conduit comprising:

an inner layer comprising a first plurality of polymers;

a middle layer comprising a second plurality of polymers;

an outer layer comprising a third plurality of polymers;

slots defined in the inner layer, middle layer, and outer layer;

a first end portion; and a second end portion opposite to the first end portion and adapted to mate with the first end portion, wherein the middle layer has a thickness greater than a thickness of the inner layer and a thickness of the outer layer.

10. A filter apparatus adapted for use in a water well, the apparatus comprising:

an inner conduit having a first inner layer, a first middle layer, and a first outer layer, a plurality of inner conduit slots, a first end portion, a second end portion opposite to the first end portion and adapted to mate with the first end portion;

the first inner layer, first middle layer and first outer layer each comprising a plurality of polymers, the first middle layer being integral with the first inner layer and the first outer layer;

a permeable cover disposed on an outer surface of the inner conduit, the permeable cover having openings with an opening cross-dimension;

an outer conduit coupled to the inner conduit and spaced apart from the inner conduit to form a gap, the outer conduit having a plurality of outer conduit slots, an outer pipe length less than the inner pipe length, the outer pipe length being such that the outer pipe covers the plurality of inner pipe slots; and filter granules disposed in the gap.

11. The filter apparatus of claim 10 wherein the first inner layer, the first middle layer and the first outer layer each comprise acrylic butadiene styrene and unplasticized polyvinyl chloride.

12. The filter apparatus of claim 10 further comprising seals coupling the outer conduit to the inner conduit.

13. The filter apparatus of claim 10 wherein:

the first end portion comprises an externally threaded portion; and the second end portion comprises an internally threaded portion.

14. The filter apparatus of claim 13 wherein the externally threaded portion and the internally threaded portion are molded.

15. A filter apparatus adapted for use in a water well, the apparatus comprising:

an inner conduit having a first inner layer, a first middle layer, and a first outer layer, a plurality of inner conduit slots, a first end portion, a second end portion opposite to the first end portion and adapted to mate with the first end portion;

the first inner layer, first middle layer and first outer layer each comprising a plurality of polymers;

an outer conduit coupled to the inner conduit and spaced apart from the inner conduit to form a gap, the outer conduit having a plurality of outer conduit slots, an outer pipe length less than the inner pipe length, the outer pipe length being such that the outer pipe covers the plurality of inner pipe slots;

the outer conduit comprising a second inner layer, a second middle layer and a second outer layer; and filter granules disposed in the gap.

16. The filter apparatus of claim 15 wherein the second inner layer, the second middle layer and the second outer layer each comprise acrylic butadiene styrene and unplasticized polyvinyl chloride.

17. A filter assembly adapted for use in a water well, the assembly comprising:

a first conduit having a first plurality of slots, a first pair of end portions, and a first a first plurality of co-extruded layers, the first plurality of co-extruded layers comprising:

a first inner layer, a first middle layer, and a first outer layer;

a second conduit removably coupled to the first conduit in an abutting end-to-end arrangement, the second conduit having a second pair of end portions and a second plurality of co-extruded layers, the second plurality of co-extruded layers comprising:

a second inner layer, a second middle layer, a second outer layer;

means for removably coupling one of the first pair of end portions of the first conduit to one of the second pair of end portions of the second conduit;

wherein the first inner layer, first middle layer and first outer layer each comprise a first composite material composed of a first plurality of polymers; and wherein the second inner layer, second middle layer and second outer layer each comprise a second composite material composed of a second plurality of polymers.

18. The assembly of claim 17 wherein the first composite material comprises acrylic butadiene styrene and unplasticized polyvinyl chloride.

19. The assembly of claim 18 wherein the second composite material comprises acrylic butadiene styrene and unplasticized polyvinyl chloride.

20. The assembly of claim 17 wherein the means for removably coupling one of the first pair of end portions of the first conduit to one of the second pair of end portions of the second conduit comprises:

a first internally threaded portion and a first externally threaded portion formed at opposite ends of the first conduit; and a second internally threaded portion and a second externally threaded portion formed at opposite ends of the second conduit.

21. The assembly of claim 20, wherein the first conduit comprises a shoulder adjacent to the first externally threaded portion, the assembly further comprising a sealing ring disposed adjacent to the shoulder.

22. A conduit adapted for use in connection with filtering water in a well, the conduit comprising:

a single wall comprising slots and a plurality of co-extruded layers, the plurality of co-extruded layers comprising at least a first layer with a first plurality of polymers and a second layer with a second plurality of polymers, the first layer being integral with second layer;

a first end portion; and a second end portion opposite to the first end portion and adapted to releasably mate with the first end portion.

23. The conduit of claim 22, wherein:

the first plurality of polymers comprises a first proportion of a first polymer and a second polymer; and the second plurality of polymers comprises a second proportion of the first polymer and the second polymer, the second proportion being different from the first proportion.

24. The conduit of claim 22, wherein:

the first plurality of polymers comprises a first polymer and a second polymer; and the second plurality of polymers comprises a third polymer and a fourth polymer.

* * * * *